US010467888B2

(12) United States Patent
Beloglazov et al.

(10) Patent No.: US 10,467,888 B2
(45) Date of Patent: Nov. 5, 2019

(54) SYSTEM AND METHOD FOR DYNAMICALLY ADJUSTING AN EMERGENCY COORDINATION SIMULATION SYSTEM

(71) Applicant: INTERNATIONAL BUSINESS MACHINES CORPORATION, Armonk, NY (US)

(72) Inventors: Anton Beloglazov, Melbourne (AU); Fernando Luiz Koch, Sáo Paulo (BR); Jan Richter, Melbourne (AU); Kent Steer, Melbourne (AU); Ziyuan Wang, Melbourne (AU)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 579 days.

(21) Appl. No.: 14/975,260

(22) Filed: Dec. 18, 2015

(65) Prior Publication Data

US 2017/0177755 A1 Jun. 22, 2017

(51) Int. Cl.
*G08B 27/00* (2006.01)
*G08B 29/12* (2006.01)

(52) U.S. Cl.
CPC ..... *G08B 27/00* (2013.01); *G08B 29/12* (2013.01)

(58) Field of Classification Search
CPC ..... G06F 17/5009; G08B 27/00
(Continued)

(56) References Cited

U.S. PATENT DOCUMENTS 7,003,525 B1 * 2/2006 Horvitz ..... G06Q 10/107
7,411,493 B2 * 8/2008 Smith ..... H04W 4/02 340/539.11

(Continued)

FOREIGN PATENT DOCUMENTS

EP 2 515 284 10/2012
EP 2 602 985 6/2013

(Continued)

OTHER PUBLICATIONS

Ji et al. ("A Crowd Evacuation System in Emergency Situation Based on Dynamics Model", Springer-Verlag Berlin Heidelberg 2006, pp. 269-280) (Year: 2006).*

(Continued)

*Primary Examiner* — Kamini S Shah
*Assistant Examiner* — Iftekhar A Khan
(74) *Attorney, Agent, or Firm* — F. Chau & Associates, LLC

(57) ABSTRACT

A method of dynamically adjusting an emergency coordination simulation system includes performing an emergency coordination simulation for a subarea of a geographic region based on expected user behavior in the subarea and environmental variables of the subarea. An emergency notice is transmitted to a plurality of users. A plurality of citizen sensor reports is received from the users via citizen sensor monitoring devices. The devices communicate with a backend system and form a citizen sensor platform. A consistency check is performed on the plurality of citizen sensor reports. The plurality of citizen sensor reports is filtered to remove outliers. An emergency coordination resimulation is performed for the subarea based on the expected user behavior in the subarea, the environmental variables of the subarea, and the filtered plurality of citizen sensor reports.

(Continued)

An updated emergency notice is transmitted to the plurality of users based on the emergency coordination resimulation.

17 Claims, 5 Drawing Sheets

(58) Field of Classification Search
USPC ..... 703/6
See application file for complete search history.

(56) References Cited

U.S. PATENT DOCUMENTS 8,013,730 B2 * 9/2011 Oh ..... G08B 25/14 340/3.1
8,175,617 B2 * 5/2012 Rodriguez ..... G01C 21/3629 455/456.1
8,435,167 B2 * 5/2013 Oohashi ..... A61M 21/02 600/27
8,745,041 B1 * 6/2014 Katragadda ..... G06F 17/30241 701/426
9,418,354 B2 * 8/2016 de Assuncao ..... G06Q 50/26
9,986,405 B1 * 5/2018 Cardonha ..... H04W 4/70
10,074,052 B2 * 9/2018 Banerjee ..... H04L 67/306
2003/0162557 A1 * 8/2003 Shida ..... H04M 3/42 455/521
2003/0187615 A1 * 10/2003 Epler ..... G06N 99/005 702/181
2004/0145481 A1 * 7/2004 Dilbeck ..... G06Q 10/06 340/573.1
2005/0017954 A1 * 1/2005 Kay ..... G06F 3/0233 345/169
2007/0216535 A1 * 9/2007 Carrino ..... G06Q 10/10 340/573.1
2008/0284587 A1 * 11/2008 Saigh ..... H04M 1/72541 340/539.13
2009/0055739 A1 * 2/2009 Murillo ..... G06F 9/451 715/708
2009/0177484 A1 * 7/2009 Davis ..... G06Q 30/02 705/346
2009/0234815 A1 * 9/2009 Boerries ..... G06F 17/30867
2009/0284348 A1 * 11/2009 Pfeffer ..... G08B 25/006 340/7.3
2010/0145976 A1 * 6/2010 Higgins ..... G06F 16/3322 707/765
2011/0046920 A1 * 2/2011 Amis ..... G01S 19/16 702/181
2011/0117878 A1 * 5/2011 Barash ..... G08B 21/0211 455/404.2
2011/0282860 A1 * 11/2011 Baarman ..... G06F 17/30864 707/709
2012/0042022 A1 * 2/2012 Sheth ..... H04L 51/32 709/206
2012/0102050 A1 * 4/2012 Button ..... G06F 16/9535 707/749
2012/0113145 A1 * 5/2012 Adhikari ..... G06Q 30/0623 345/633
2012/0136865 A1 * 5/2012 Blom ..... G06F 16/173 707/739
2012/0179421 A1 * 7/2012 Dasgupta ..... G05B 23/0281 702/181
2012/0282887 A1 * 11/2012 Khoo ..... G08G 1/205 455/404.2
2012/0290950 A1 * 11/2012 Rapaport ..... H04L 51/32 715/753
2013/0066609 A1 * 3/2013 Gilkes ..... G09B 29/007 703/6
2014/0052681 A1 * 2/2014 Nitz ..... H04L 51/02 706/46
2014/0167953 A1 * 6/2014 Dunlop ..... G09B 19/00 340/515
2014/0297661 A1 * 10/2014 de Assuncao ..... G06Q 50/26 707/752
2015/0084757 A1 * 3/2015 Annibale ..... G08B 25/10 340/436
2015/0302425 A1 * 10/2015 Borger ..... G06Q 30/0201 705/7.29
2015/0324871 A1 * 11/2015 Beloglazov ..... G06Q 30/0282 705/347
2015/0348407 A1 * 12/2015 Avegliano ..... H04W 4/02 701/118
2016/0162837 A1 * 6/2016 Muntes Mulero ... G06Q 10/103 705/301

FOREIGN PATENT DOCUMENTS

EP 2 615 801 7/2013
WO WO 2008/045798 4/2008
WO WO 2012/078475 6/2012

OTHER PUBLICATIONS

Jain et al. ("Modeling and Simulation for Emergency Response: Workshop Report, Standards and Tools", , NISTIR 7071, 2003, pp. 1-116) (Year: 2003).*
Gao et al. ("Harnessing the Crowdsourcing Power of Social Media for Disaster Relief", IEEE, 2011, pp. 10-14) (Year: 2011).*
Kathryn Blackmond Laskey ("Crowdsourced Decision Support for Emergency Responders", 18th International Command and Control Research and Technology Symposium, 2014, pp. 1-17) (Year: 2014).*
Tierney, K. J., Lindell, M. T. & Perry, R. W. 2001. Facing the Unexpected: Disaster Preparedness and Response in the United States. Washington, DC: Joseph Henry Press/National Academy Press.
Mileti, D., Bandy, R., Bourque, L.B., Johnson, A., Kano, M., Peek, L., Sutton, J.N. & Wood, M. 2006. Annotated Bibliography for Public Risk Communication on Warnings for Public Protective Actions Response and Public Education.
Sutton, Jeannette, Leysia Palen, and Irina Shklovski. Backchannels on the front lines: Emergent uses of social media in the 2007 southern California wildfires. Proceedings of the 5th International ISCRAM Conference,Washington, DC, 2008.
Boulos, et al. "Crowdsourcing, citizen sensing and sensor web technologies for public and environmental health surveillance and crisis management : trends, OGC standards and application examples." International journal of health geographics 10.1 (2011): 67.
Roitman, Haggai, et al. "Harnessing the Crowds for smart city sensing." Proceedings of the 1st international workshop on Multimodal crowd sensing . (pp. 17-18), ACM, 2012.
Schulz, Axel, Heiko Paulheim, and Florian Probst. "Crisis information management in the web 3.0 age." 9th International ISCRAM Conference (Information Systems for Crisis Response and Management). 2012, pp. 1-5.
Radianti, et al., Crowd Models for Emergency Evacuation: A Review Targeting Human-Centered Sensing, 2013 46th Hawaii International Conference on System Sciences, pp. 156-165, IEEE Press, 2013.

* cited by examiner

SYSTEM AND METHOD FOR DYNAMICALLY ADJUSTING AN EMERGENCY COORDINATION SIMULATION SYSTEM

BACKGROUND

Exemplary embodiments of the present invention relate to an emergency coordination simulation system. More particularly, exemplary embodiments of the present invention relate to a system and method for dynamically adjusting an emergency coordination simulation system.

Generally, simulation systems make predications based on a number of estimated or predicated variables. An emergency simulation system, for instance, may make a number of assumptions regarding emergency response times and the reactions of individuals involved in an emergency situation to generate predictions about such an emergency situation and to deliver notifications to individuals who may be involved in an emergency situation. Thus, notifications provided to individuals impacted by such an emergency situation may be based on simulated scenarios and hypothetical or predicted data applied in the simulated scenario.

Emergency situation notifications may include information regarding suggested emergency evacuation routes or suggested geographic regions or subregions that should be avoided during an emergency evacuation. The suggested evacuation route notifications may be based on simulated evacuation scenarios, which might not incorporate unforeseen or unpredictable factors, such as blocked roadways or power outages. Thus, simulated evacuation scenarios may be inherently flawed and may lead to emergency situation notifications that include inaccurate or unreliable information.

It may be desirable to increase the accuracy and reliability of emergency simulation systems by incorporating information that becomes available during the emergency situation.

SUMMARY

Exemplary embodiments of the present invention provide a method of dynamically adjusting an emergency coordination simulation system including performing an emergency coordination simulation for a subarea of a geographic region based on expected user behavior in the subarea and environmental variables of the subarea. An emergency notice is transmitted to a plurality of users in the subarea based on the emergency coordination simulation. A plurality of citizen sensor reports is received from the users via citizen sensor monitoring devices. The citizen sensor monitoring devices communicate with a backend system and form a citizen sensor platform. A consistency check is performed on the plurality of citizen sensor reports by comparing the citizen sensor reports with one another. The plurality of citizen sensor reports is filtered to remove outliers based on the consistency check. An emergency coordination resimulation is performed for the subarea based on the expected user behavior in the subarea, the environmental variables of the subarea, and the filtered plurality of citizen sensor reports. An updated emergency notice is transmitted to the plurality of users based on the emergency coordination resimulation.

According to an exemplary embodiment of the present invention each citizen sensor report may include first data manually entered by one of the users and second data automatically detected by the citizen sensor monitoring device used by the one of the users.

According to an exemplary embodiment of the present invention the second data may include location data detected by a Global Positioning System (GPS) radio disposed in the citizen sensor monitoring device used by the one of the users.

According to an exemplary embodiment of the present invention the second data may include a tuple. The tuple may include a latitude value detected by the corresponding citizen sensor monitoring device and indicating a latitude of the corresponding citizen sensor monitoring device, a longitude value detected by the corresponding citizen sensor monitoring device and indicating a longitude of the corresponding citizen sensor monitoring device, and an altitude value detected by the corresponding citizen sensor monitoring device and indicating an altitude of the corresponding citizen sensor monitoring device. The tuple may include a report type value indicating a type of the corresponding citizen sensor report. The tuple may include a priority value indicating a calculated priority of the corresponding citizen sensor report. The tuple may include a reputation value indicating a calculated reputation of the corresponding citizen sensor report.

According to an exemplary embodiment of the present invention the emergency notice and the updated emergency notice may each include at least one of a description of an emergency in the subarea and a recommended course of action responsive to the emergency in the subarea.

According to an exemplary embodiment of the present invention the method of dynamically adjusting an emergency coordination simulation system may include storing the citizen sensor reports in a database at the backend system, and indexing the citizen sensor reports.

According to an exemplary embodiment of the present invention the citizen sensor monitoring devices may include a Smartphone.

According to an exemplary embodiment of the present invention the method of dynamically adjusting an emergency coordination simulation system may include performing additional emergency coordination simulations for neighboring subareas that neighbor the subarea of the geographic region. The updated emergency notice may be modified based on the additional emergency coordination simulations. The modified updated emergency notice may be transmitted to the plurality of users.

Exemplary embodiments of the present invention provide an emergency coordination simulation system including a memory storing a computer program, and a processor configured to execute the computer program. The processor is configured to perform an emergency coordination simulation for a subarea of a geographic region based on expected user behavior in the subarea and environmental variables of the subarea. The processor is configured to transmit an emergency notice to a plurality of users in the subarea based on the emergency coordination simulation. The processor is configured to receive a plurality of citizen sensor reports from the users via citizen sensor monitoring devices. The citizen sensor monitoring devices communicate with the emergency coordination simulation system and form a citizen sensor platform. The processor is configured to perform a consistency check on the plurality of citizen sensor reports by comparing the citizen sensor reports with one another. The processor is configured to filter the plurality of citizen sensor reports to remove outliers based on the consistency check. The processor is configured to perform an emergency coordination resimulation for the subarea based on the expected user behavior in the subarea, the environmental variables of the subarea, and the filtered plurality of citizen sensor reports. The processor is configured to transmit an updated emergency notice to the plurality of users based on the emergency coordination resimulation.

According to an exemplary embodiment of the present invention the processor may be configured to perform additional emergency coordination simulations for neighboring subareas that neighbor the subarea of the geographic region. The processor may be configured to modify the updated emergency notice based on the additional emergency coordination simulations. The processor may be configured to transmit the modified updated emergency notice to the plurality of users.

Exemplary embodiments of the present invention provide a computer program product for dynamically adjusting an emergency coordination simulation system. The computer program product includes a computer readable storage medium having program instructions embodied therewith, the program instructions executable by a processor to cause the processor to perform an emergency coordination simulation for a subarea of a geographic region based on expected user behavior in the subarea and environmental variables of the subarea. The program instructions executable by the processor cause the processor to transmit an emergency notice to a plurality of users in the subarea based on the emergency coordination simulation. The program instructions executable by the processor cause the processor to receive a plurality of citizen sensor reports from the users via citizen sensor monitoring devices. The citizen sensor monitoring devices communicate with a backend system and form a citizen sensor platform. The program instructions executable by the processor cause the processor to perform a consistency check on the plurality of citizen sensor reports by comparing the citizen sensor reports with one another. The program instructions executable by the processor cause the processor to filter the plurality of citizen sensor reports to remove outliers based on the consistency check. The program instructions executable by the processor cause the processor to perform an emergency coordination resimulation for the subarea based on the expected user behavior in the subarea, the environmental variables of the subarea, and the filtered plurality of citizen sensor reports. The program instructions executable by the processor cause the processor to transmit an updated emergency notice to the plurality of users based on the emergency coordination resimulation.

According to an exemplary embodiment of the present invention the program instructions executable by a processor may cause the processor to perform additional emergency coordination simulations for neighboring subareas that neighbor the subarea of the geographic region. The program instructions executable by the processor may cause the processor to modify the updated emergency notice based on the additional emergency coordination simulations, and transmit the modified updated emergency notice to the plurality of users.

BRIEF DESCRIPTION OF THE DRAWINGS

The above and other features of the present invention will become more apparent by describing in detail exemplary embodiments thereof, with reference to the accompanying drawings, in which.

DETAILED DESCRIPTION

Figure 1:
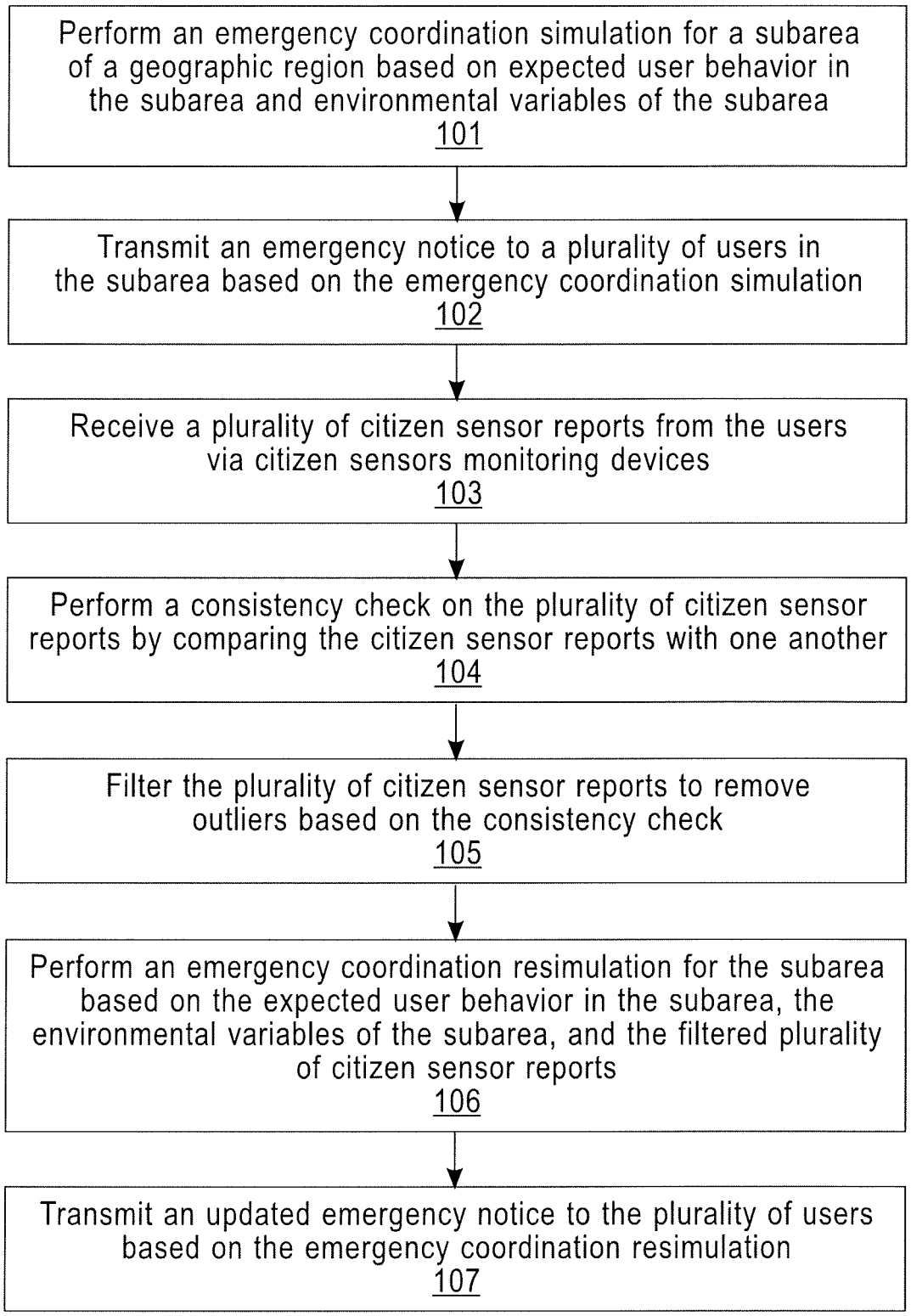
FIG. 1 illustrates a flow chart of a method of dynamically adjusting an emergency coordination simulation system according to an exemplary embodiment of the present invention.

An emergency coordination simulation system may make predications based on a number of estimated or predicated variables to simulate an emergency situation. Simulating the emergency situation may generate a number of notifications to be delivered to individuals in a particular geographic region who will be affected by the emergency situation. For example, notifications may be generated regarding the fastest evacuation route from a flood or hurricane based on the simulated emergency situation. However, the suggested evacuation route might not incorporate unforeseen or unpredictable factors, such as blocked roadways or power outages, that would not be available prior to the emergency situation, but which could be provided by individuals observing the actual events of an emergency situation in real time. Similarly, emergency crews may seek to efficiently prepare for and coordinate emergency response efforts, and incorporating reports from the individuals observing the actual events of an emergency situation in real time may increase the efficiency and effectiveness of emergency response efforts.

Exemplary embodiments of the present invention provide a method of dynamically adjusting an emergency coordination simulation system. Information received from individuals observing or involved in the emergency situation may provide reports to the emergency simulation system to continually and dynamically resimulate the emergency situation based on the reports. Thus, the methods and system according to exemplary embodiments of the present invention may allow for continuous review of the simulation parameters based on field input to increase the precision of the emergency situation simulation and increase the quality of emergency coordination.

A notice according to exemplary embodiments of the present invention may refer to an abstract container of information and/or recommendations which may help a citizen to better understand their environment and current situation.

A Citizen Sensor Platform (CSP) according to exemplary embodiments of the present invention may refer to an emerging paradigm in social computing research, which may be defined as a network of interconnected participatory citizens who provide intentional and non-intentional observations (or reports) in a specific context. The CSP may instrument citizens and cities, interconnect parties, analyze related events, and provide notice and feedback reports.

Citizen Sensor Monitors (CSM) or citizen sensor monitoring devices according to exemplary embodiments of the present invention may refer to software solutions deployed on end-user's mobile computing devices that may allow them to report situations on the spot. These reports may generate Citizen Sensor Events (CSE) that mark situations like security threads, the occurrence of potholes, pollution in creeks, traffic jams, problem in public illumination, and others.

Citizen Sensing Reports (CSR) according to exemplary embodiments of the present invention may refer to the combination of end-users' entered annotations with automated sensed information. These reports may be transmitted to a remote server where the data is stored, indexed, and grouped. This information may be used for running analysis and generating reports, and may be used by the emergency coordination simulation system according to an exemplary embodiment of the present invention.

Exemplary embodiments of the present invention may provide a system and method that applies event reports submitted through the CSP to reconsider and adjust the notices being generated by scenario simulation in emergency coordination scenarios. The invention may increase the accuracy and reliability of scenario simulator platforms (e.g., a simulator for emergency evacuation scenarios) able to dynamically adjust its notices for specific regions based on the feedback provided by end-users applying the notice, collected through Citizen Sensing (i.e., participatory sensing) infrastructure.

The terms "affected people," "end-users," "users" and "citizens" may be used interchangeably herein to refer to individuals affected by an emergency situation, individuals receiving notices or reports and/or individuals providing notices or reports to the simulation system.

Exemplary embodiments of the present invention will be described in more detail below with reference to the accompanying drawings. Like reference numerals may refer to like elements throughout the specification and drawings.

FIG. 1 illustrates a flow chart of a method of dynamically adjusting an emergency coordination simulation system according to an exemplary embodiment of the present invention.

Referring to FIG. 1, a method of dynamically adjusting an emergency coordination simulation system according to an exemplary embodiment of the present invention includes performing an emergency coordination simulation for a subarea of a geographic region based on expected user behavior in the subarea and environmental variables of the subarea 101. An emergency notice is transmitted to a plurality of users in the subarea based on the emergency coordination simulation 102. A plurality of citizen sensor reports is received from the users via citizen sensor monitoring devices 103. The citizen sensor monitoring devices communicate with a backend system and form a Citizen Sensor Platform (CSP). A consistency check is performed on the plurality of citizen sensor reports by comparing the citizen sensor reports with one another 104. The plurality of citizen sensor reports is filtered to remove outliers based on the consistency check 105. An emergency coordination resimulation is performed for the subarea based on the expected user behavior in the subarea, the environmental variables of the subarea, and the filtered plurality of citizen sensor reports 106. An updated emergency notice is transmitted to the plurality of users based on the emergency coordination resimulation 107.

A transportation network may include a plurality of roads, bridges, highways, public transportation segments and transfer points and the like. The transportation network may be used by people to move about to avoid or in response to an emergency situation. The transportation network may be used by affected people or by emergency response personnel during an emergency situation such as a hurricane, a flood, a fire or a natural disaster. A transportation network may be partitioned into a plurality of subareas. Subareas may overlap each other.

According to exemplary embodiments of the present invention each of the subareas may be simulated independently based on predicted timing and route of vehicles passing through a particular subarea (e.g., details of any trips originating within the subarea). The boundary of a partition may be defined by a set of road network nodes. Every trip in a scenario may be broken into sub-trips, one for each subarea it passes through, punctuated by the boundary nodes. For each sub-trip estimates may be made for the time the vehicle enters each subarea (e.g., the estimated arrival time). The estimated arrival time may be based on nominal traffic conditions, a full simulation, or some other approach. Individual 'subarea simulations' using the estimated arrival times for each sub-trip which passes through the subarea may be performed. Thus, estimation for transit time through each subarea based on simulations may be combined to determine an overall transit time over a larger geographic area. Transit times through subareas according to exemplary embodiments of the present invention may be resimulated according to newly received reports, as discussed below in more detail.

According to an exemplary embodiment of the present invention, after actual data or reports are received regarding actual transit time, each subarea may be resimulated and an overall transit time may be updated. Once the subarea simulation completes the timing of vehicles actually reaching the boundaries may be compared with the resimulation or the simulated estimates. The difference between these estimates may be a result of inaccuracy in the initial estimates, or changes of the subarea simulation input conditions (e.g., adjusted number of vehicles entering the subarea). If the estimates differ significantly, this may justify resimulation of the neighboring subarea. Resimulations may use the results of the neighboring simulations or resimulations as input. Particular transit or travel routes through each subarea may be adjusted and updated reports or notices may be sent to affected individuals or emergency response personnel.

According to exemplary embodiments of the present invention, a decision to resimulate a particular subarea may be based on a predetermined threshold. The predetermined threshold may be a predetermine difference between an estimated travel time and an actually observed travel time. For example, if a single vehicle passing through a particular subarea has a travel time that is about 10 seconds different than a predicted travel time then the resimulation might not be performed. However, if 100 vehicles passing through the particular subarea each experience a travel time that is about 10 seconds different than the initially simulated travel time, then that subarea and/or a number of neighboring subareas may be resimulated, and the observed travel times may be incorporated into the resimulation.

A decision to resimulate a number of neighboring subareas may be made based on the degree of changes in the subarea simulation input conditions. For example, if 100 extra trips are added, it may imply a significant impact on the neighboring areas resulting in an extended resimulation subarea. Thus, an observed difference between predicted and observed transit times may trigger resimulation of a number of neighboring subareas.

According to an exemplary embodiment of the present invention the number and size of the neighboring subareas which undergo the resimulation may be calculated based on the expected processing time for performing the resimulation of the initial subarea observed to have different transit times than we predicted based on the initial simulation. For example, a criterion for pre-selecting multiple neighboring subareas for resimulation may be the execution time of the simulator, which may be a constraint in an emergency. Such a limit on the execution time may be defined by an incident commander (e.g., a resimulation should take no longer than 30 seconds). If based on the simulation history it may be estimated that a resimulation of a single subarea takes approximately 5 seconds, then 5 neighboring subareas can be automatically selected for resimulation to obtain more accurate results of the impact of the subarea resimulation on the neighboring areas.

According to an exemplary embodiment of the present invention each citizen sensor report may include first data manually entered by one of the users and second data automatically detected by the citizen sensor monitoring device used by the one of the users.

According to an exemplary embodiment of the present invention the second data may include location data detected by a Global Positioning System (GPS) radio disposed in the citizen sensor monitoring device used by the one of the users.

According to an exemplary embodiment of the present invention the second data may include a tuple. The tuple may include a latitude value detected by the corresponding citizen sensor monitoring device and indicating a latitude of the corresponding citizen sensor monitoring device, a longitude value detected by the corresponding citizen sensor monitoring device and indicating a longitude of the corresponding citizen sensor monitoring device, and an altitude value detected by the corresponding citizen sensor monitoring device and indicating an altitude of the corresponding citizen sensor monitoring device. The tuple may include a report type value indicating a type of the corresponding citizen sensor report. The tuple may include a priority value indicating a calculated priority of the corresponding citizen sensor report. The priority may be based on analysis of the textual content of the report or from predefined priority levels for tags/categories associated with the report. The tuple may include a reputation value indicating a calculated reputation of the corresponding citizen sensor report. For example, the priority may be urgent if the report may indicate significant impact of the simulation. The reputation may be calculated based on the accuracy and reliability of the user's historical reports.

According to an exemplary embodiment of the present invention the emergency notice and the updated emergency notice may each include at least one of a description of an emergency in the subarea and a recommended course of action responsive to the emergency in the subarea.

According to an exemplary embodiment of the present invention the method of dynamically adjusting an emergency coordination simulation system may include storing the citizen sensor reports in a database at the backend system, and indexing the citizen sensor reports.

According to an exemplary embodiment of the present invention the citizen sensor monitoring devices may include a smartphone.

According to an exemplary embodiment of the present invention the method of dynamically adjusting an emergency coordination simulation system may include performing additional emergency coordination simulations for neighboring subareas that neighbor the subarea of the geographic region. The updated emergency notice may be modified based on the additional emergency coordination simulations. The modified updated emergency notice may be transmitted to the plurality of users.

Figure 2:
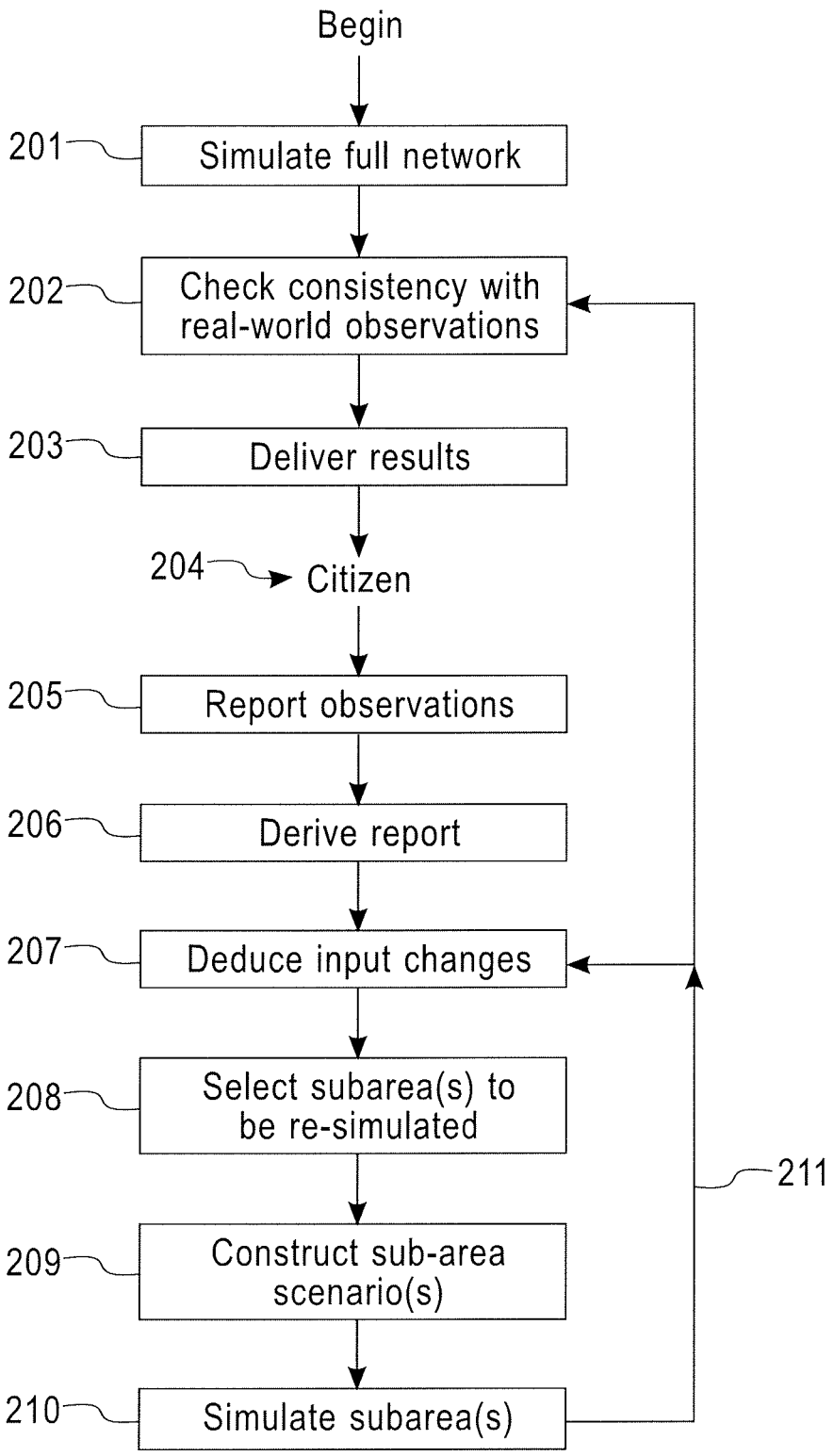
FIG. 2 illustrates a flow chart of a method of dynamically adjusting an emergency coordination simulation system according to an exemplary embodiment of the present invention.

FIG. 2 illustrates a flow chart of a method of dynamically adjusting an emergency coordination simulation system according to an exemplary embodiment of the present invention.

Referring to FIG. 2, an emergency coordination simulation may begin or may be triggered when some event suggests there may be a need for notices to be delivered to citizens. For example, a high risk fire forecast may initiate the system. Alternatively, the system could be operating in perpetuity, such as in an area where an emergency or natural disaster is expected to occur. Thus, an initial full network simulation 201 may be performed which may be the basis for a first generation of notices to be issued to the affected individuals who are identified based on the initial full network simulation.

According to exemplary embodiments of the present invention the generated notices may be checked for consistency with real-world observations 202 (e.g., any reports that may have been provided prior to the initial full network simulation 201). Initially there might not be any reports, and thus inconsistencies between an initial full network simulation 201 and real-world observations would not be identified on a first analysis of whether to resimulate the emergency situation. The system and method according to exemplary embodiments of the present invention may deliver results 203 after comparing the full network simulation 201 with real-world observations 203 and initial reports may be delivered to citizens 204. Thus, after the notices have passed a consistency check they may be delivered to the relevant citizens in the relevant area(s). As discussed below in more detail, subsequent simulation iterations checking the consistency of the generated notices with real-world observations 202 may compare reports with the notices generated by the subarea simulation, and thus it may be possible to reduce or prevent the issuance of notices that contradict trusted reports.

According to exemplary embodiments of the present invention citizens may receive and review delivered reports and report observations 206 based either on observed consistencies or inconsistencies between the received reports and the conditions observed. That is, citizens may optionally provide feedback on the consistency between the notices and their real-world observations. Citizens may also provide reports on observations or new incidents independently. A CSP may be generated and citizens may be able to observe and comment on notices being sent to other citizens. For example, a citizen may observe a particular notice or report that they know to be inaccurate and may enter a comment in the CSP to notify the affected citizens that the notice or report includes an error. Citizens may also post comments corrected a flawed report or notice through the CSP.

The system and method according to exemplary embodiments of the present invention may derive a report 206 for use by the system based on the notices or reports received from citizens and may deduce input changes 207 based on a comparison between the received reports and the scenarios predicted by the initial simulation. For example, the CSP (see, e.g., FIG. 3), discussed below in more detail, may assimilate citizen reports and use the reports to select subareas to be resimulated 208. For example, the assimilated reports may be compared to the output of previous simulations to deduce changes in input conditions and data for a resimulation. The identified input changes may be used to select the subareas to be resimulated 208 to construct subarea scenarios 209. Once the resimulation areas have been determined a region-specific scenario may be constructed including boundary conditions and internal events. Thus, the selected subareas may be simulated 210 and new notices may be generated.

According to an exemplary embodiment of the present invention, subsequent simulation iterations checking the consistency of the generated notices with real-world observations 202 may compare reports with the notices generated by the subarea simulation 211, and thus it may be possible to reduce or prevent the issuance of notices that contradict trusted reports. That is, resimulations of each of the subareas may be used to improve the accuracy of the emergency scenario simulation by comparing the reports received for each subarea with the notices provided to each subarea.

Figure 3:
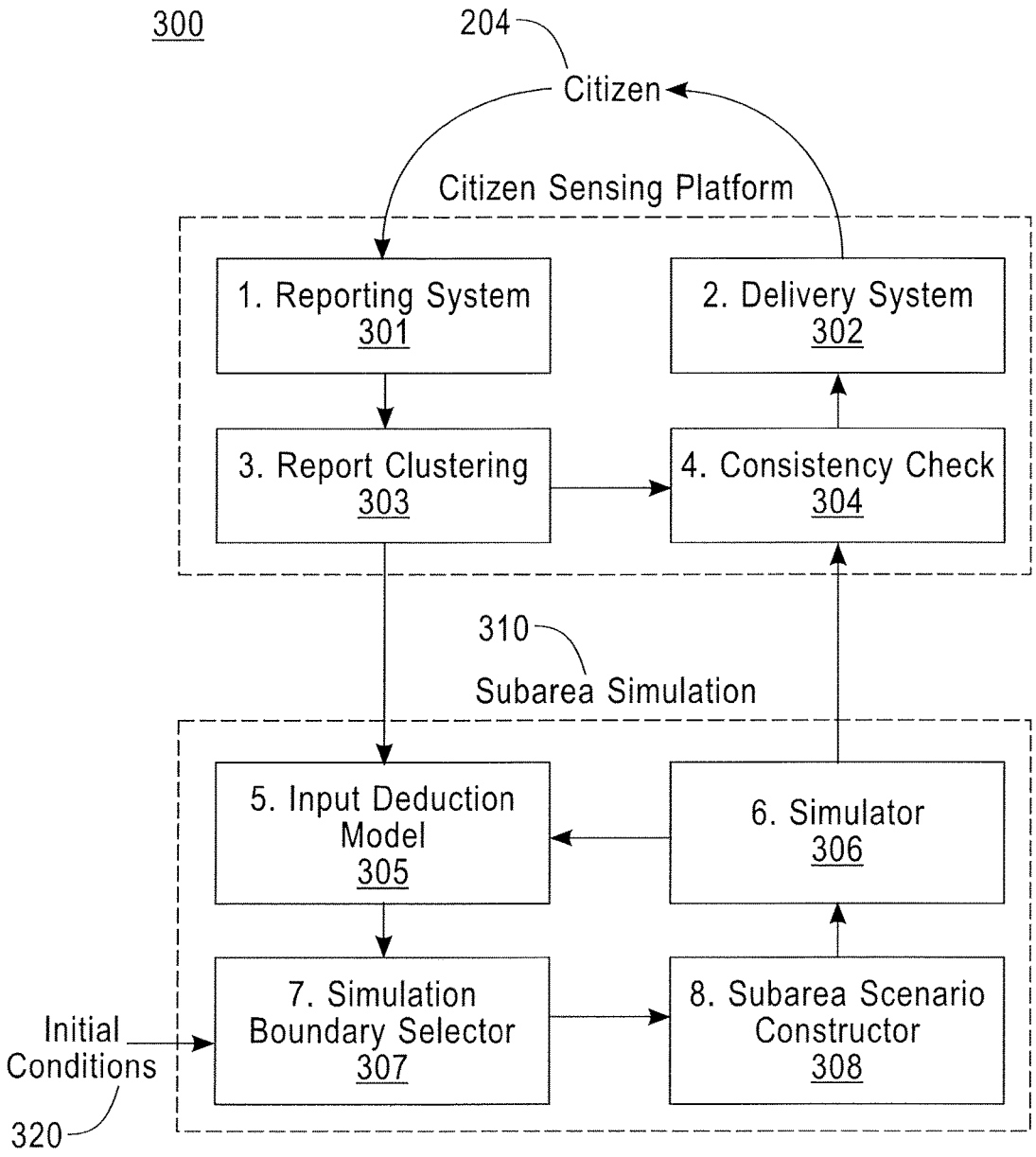
FIG. 3 illustrates an emergency coordination simulation system according to an exemplary embodiment of the present invention.

FIG. 3 illustrates an emergency coordination simulation system according to an exemplary embodiment of the present invention.

Referring to FIG. 3, an emergency coordination simulation system according to an exemplary embodiment of the present invention includes citizen sensing platform 300 including a reporting system 301, a delivery system 302, a report clustering unit 303, a consistency checking unit 304, and a subarea simulation unit 310 including an input deduction model unit 305, a simulator 306, a simulation boundary selector 307, and a subarea scenario constructor 308. The subarea simulation unit 310 may receive initial conditions 320, which may be based on known conditions or may be based on assumptions prior to an emergency situation.

The subarea simulation unit 310 may perform an initial subarea simulation for each of the desired subareas based on data regarding the initial conditions 320 in each of the subareas. Additional simulation iterations (e.g., resimulations) may be performed for each subarea as new citizen reports are received.

The citizen sensing platform 300 according to exemplary embodiments of the present invention may continually and dynamically deliver notices to citizens 204, and the citizens 204 may provide reports to the citizen sensing platform 300 regarding the emergency situation. For example, the citizens 204 may verify the accuracy of received notices or may provide new information identifying the inaccuracies of the notices. Thus, the accuracy of delivered notices may be continually and dynamically increased over time as citizens 204 provide information and the citizen sensing platform continually and dynamically resimulates the emergency situation based on the most recently provided information.

The reporting system 301 according to exemplary embodiments of the present invention may include a user interface or may provide reports to a user's mobile device such as a Smartphone or a computer (e.g., through the delivery system 302 described below in more detail). The reporting system 301 may receive, store, and index Citizen Sensor Reports, forming the set of citizen sensor reports $R=\{r_1, \ldots, r_n\}$, where each Citizen Sensor Report ri=<lat, lon, alt, type, prio, rep>, a tuple of the attributes assigned during the reporting and its processing as: lat is the latitude (1), ion in the longitude (1), alt is the altitude (1), type of report (2), prio is the calculated priority (3), and rep is the calculated reputation (3), where: (1) it is assumed that these attributes have been assigned by the reporting device, as, e.g., through data collected from a GPS system), (2) it is assumed that these attributes have been selected by the end-user through the application interface, and (3) it is assumed that these attributes have been calculated and assigned during the processing, by other modules.

The delivery system 302 according to exemplary embodiments of the present invention may provide notifications to the users. The delivery system 302 may deliver notices being generated by the simulation method and stored set of notifications $N=\{N_1, \ldots, N_n\}$ to end-users located in the related areas. The method implements multiple protocols to deliver notices to users, such as request based, pushed notices, based on local context, and others. However, exemplary embodiments of the present invention are not limited to a particular protocol and any desired protocol may be employed by the systems and methods according to exemplary embodiments of the present invention.

The report clustering unit 303 may execute one or more algorithms to group similar reports and calculate "priority level" and "reputation ranking" of Citizen Sensing Reports. Report clustering may be done using standard clustering approaches (e.g., k-means), after extracting some features from the reports. Similar reports may be aggregated to calculate a combined priority level, and the combination may account for (e.g., via weighting) the reputation ranking of contributors. For example, a scenario simulator may be used by the central operation in an emergency coordination environment. This simulator may include a representation of the environment's parameters, including infrastructure, geography, social behavior, traffic conditions, environmental events, and others. These parameters may be processed by internal rules to estimate the (possible) evolutions of the environment in the foreseeable future. This information may be used by the central operators to reason upon the situation and issue notices to people in the affected areas about the best course of actions, intending to (a) reduce individuals' risk, (b) estimate the evolution of the emergency scenario, (c) predict the amount of resources required by the relief forces, and others.

The notice end-users (e.g., people in affected areas) may be equipped with Citizen Sensor Monitors (CSM), which may be applications or software solutions deployed on end-user's mobile computing devices that allow them to report situations on the spot. The end-users may receive the notices being issued by the central operations and are able to respond either (i) positively, reinforcing the accuracy of the notice, or (ii) negatively, raising a flag about the accuracy of the notice. The end-users may comment on notices being provided to other people nearby in the same fashion, and provide comments on actions being taken by people in surrounding areas, forming a "ad-hoc social network" of notices and reviewing. This information may be used to calculate the "reputation coefficient" and assign "priority levels" to the Citizen Sensor Reports. The extended dynamic and self-adjusting scenario simulator according to an exemplary embodiment of the present invention may receive these comments, and may analyze the comments for accuracy and reliability. If the computation concludes that there is a significant amount of negative comments for notices given in a specific area and/or specific group of people, it may: (a) review the parameters and rules being applied for that specific area and/or specific group of people; (b) re-execute the simulation for that subarea using the new parameters, and; (c) re-issue the notices to that specific areas and/or specific group of people. Thus, the accuracy and reliability of the generated notices may be continually and dynamically increased over time.

The consistency check unit 304 according to exemplary embodiments of the present invention may analyze the consistency of the set of notices when cross related to the set of Citizen Sensor Reports. This process may increase the quality of service by filtering notifications that are clearly conflicting with situations being observed by end-users in the field. The filtering may include area-specific and time-related checking as well as the correlation between the corresponding reported observations and the notices obtained from the subarea simulation. For example, if the notice specifies a significantly reduced congestion in an area with higher reported congestion levels, the consistency check may filter that notice if the timeframe for a rapid reduction is not within the acceptable error bounds (e.g., based on expert knowledge). The consistency check component may also notify the subarea simulation about the level of conflicting citizen notifications with citizen reports to enable a readjustment of input conditions and trigger a resimulation.

The input deduction model unit 305 according to exemplary embodiments of the present invention may determine input conditions for initializing a simulation. A decision to initiate a simulation may be based on real-world observations and/or simulation outputs, for example. Input conditions may have spatial and/or temporal dimensions, or may be more general (e.g., behavior parameters).

A process for determining input conditions for initializing a simulation may include identifying the type of input that can be derived from the data report, input conditions may be deduced from the report, and the derived input conditions may be passed along to a simulation boundary selector 307, discussed in more detail below.

The type of data that can be derived from the data report may include a timeframe (e.g., a time from which point in the simulation time the simulation should be rerun). The type of data that can be derived from the data report may include a location (e.g., the location of input changes such as the set of road network nodes to which the changes apply). The type of data that can be derived from the data report may include a change of input condition and data (e.g., removal of links based on reported blocked roads, reduction of speed limits which may result from smog, smoke, road damage etc.), vehicle numbers (e.g., reported vehicle congestion), vehicle modes, change of route choices, or intersection control malfunctions. Deduced input conditions from the report may include direct mapping in the case of a road block (e.g., link removal), estimation of input change for non-direct related report data (e.g., derive change of vehicle numbers in a an area based on reported congestion).

The simulator 306 according to exemplary embodiments of the present invention may execute one or more algorithms to execute the scenario simulation. These algorithms are embodied in, for example, fire spread simulators, behavioral modelling and traffic simulators. A module of the simulator 306 may apply rules of operation that take into consideration the set of expected user behavior for a region, the set of environment behavior variables for a region, and the set of Citizen Sensor Reports (e.g., $R=\{r_1, \ldots, r_n\}$). The execution of the simulation may generate region-specific notices containing details of the events that can be expected in the specific region. These notices may include recommendations, or may be descriptions of the emergency situation.

The simulation boundary selector 307 according to exemplary embodiments of the present invention may implement one or more algorithms for selecting spatial and temporal boundaries for simulation or resimulation of a subarea based on specifications received from the input deduction model unit 305. For example, the resimulation subarea may be based on the distance from the site of the new information obtained through Citizen Sensor Reports. One or more algorithms may account for adjacency effects to determine a region of consequence for the updated information. The input deduction model unit 305 may deliver a set of points where the simulation input conditions have changed associated with the time of the change to the simulation boundary selector 307. Exemplary steps performed by the simulation boundary selector 307 are described in more detail below with reference to FIG. 4A.

Figure 4A:
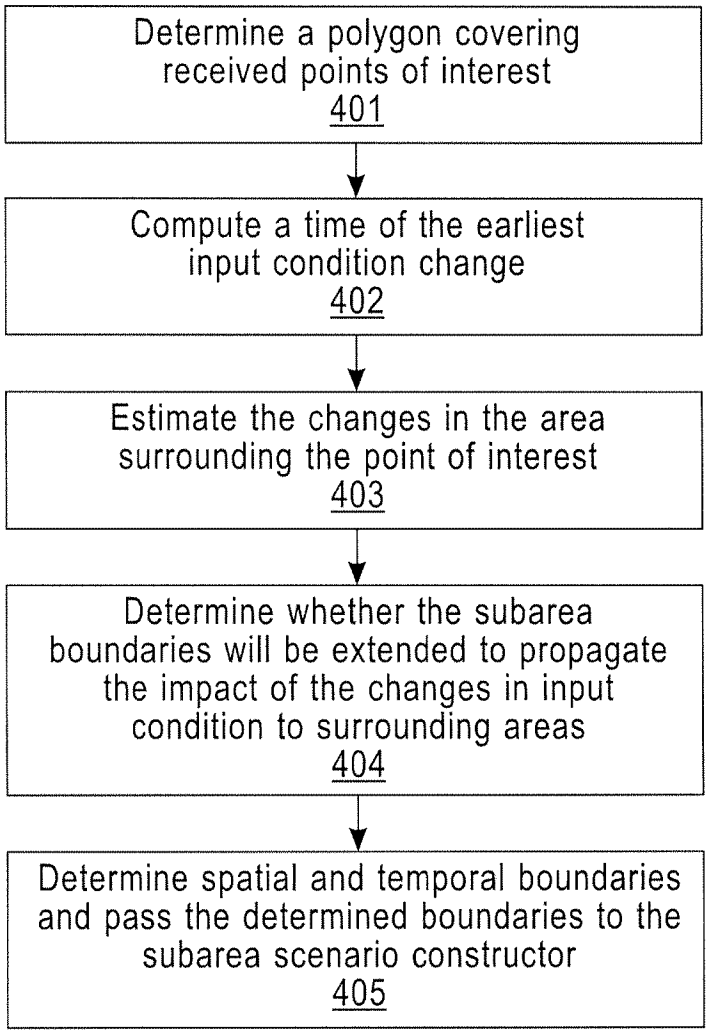
FIG. 4A illustrates a flow chart of a method of simulation boundary selection according to an exemplary embodiment of the present invention.

FIG. 4A illustrates a flow chart of a method of simulation boundary selection according to an exemplary embodiment of the present invention.

Referring to FIG. 4A, the simulation boundary selector 307 may determine a polygon covering received points of interest 401. The polygon covering received points of interest 401 may represent a geographic area of interest. The simulation boundary selector 307 may compute a time of the earliest input condition change 402. The time of the earliest input condition change 402 may indicate a start time of the subarea simulation. The simulation boundary selector 307 may estimate the changes in the area surrounding a point of interest 403. For example, based on the significance of changes in the input conditions at every reported point, the impact of the changes on the surrounding areas may be estimated, and thus the subarea simulation or resimulation may be adjusted based on the changes. The simulation boundary selector 307 may determine whether the subarea boundaries will be extended to propagate the impact of the changes in input conditions to surrounding areas 404. The simulation boundary selector 307 may determine spatial and temporal boundaries and pass the determined boundaries to the subarea scenario constructor 405.

The subarea scenario constructor 308 may implement one or more algorithms for defining the input parameters to initiate a subarea simulation or resimulation. The algorithms may use subarea space-time parameters to partition prior input data sets and update information that has changed. Thus, the boundary conditions may include the best-known description of the real-world scenario. Exemplary steps performed by the subarea scenario constructor 308 are described below in more detail with reference to FIG. 4B.

Figure 4B:
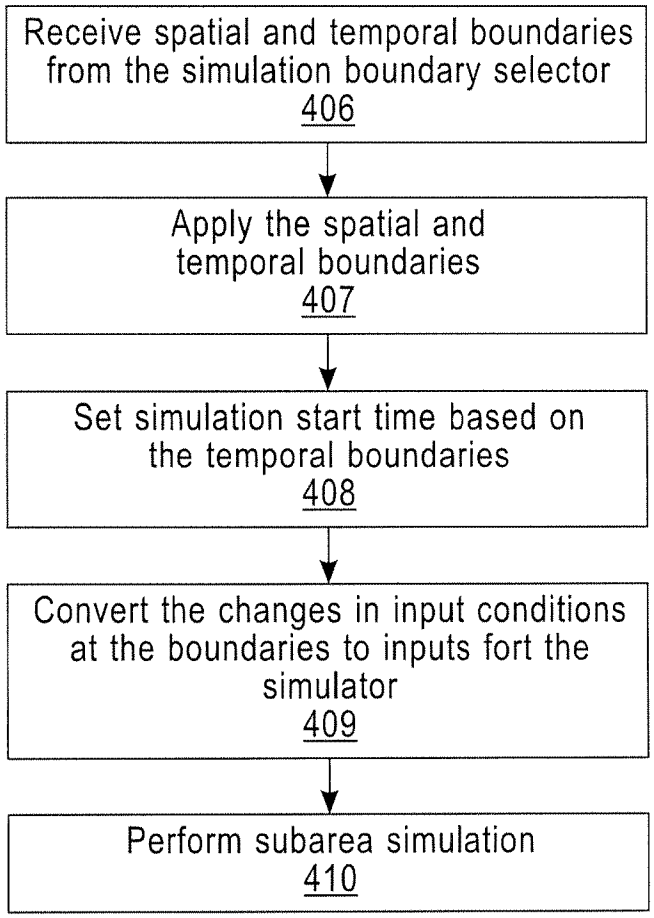
FIG. 4B illustrates a flow chart of a method of subarea scenario construction according to an exemplary embodiment of the present invention.

FIG. 4B illustrates a flow chart of a method of subarea scenario construction according to an exemplary embodiment of the present invention.

Referring to FIG. 4B, the subarea scenario constructor 308 may receive spatial and temporal boundaries from the simulation boundary selector 406. The subarea scenario constructor 308 may apply the spatial and temporal boundaries 407 for the subarea simulation or resimulation. The subarea scenario constructor 308 may set a simulation start time based on the temporal boundaries 408. The subarea scenario constructor 308 may convert the changes in input conditions at the boundaries to inputs for the simulator 409. The subarea scenario constructor 308 may perform the subarea simulation 410 or resimulation.

Figure 5:
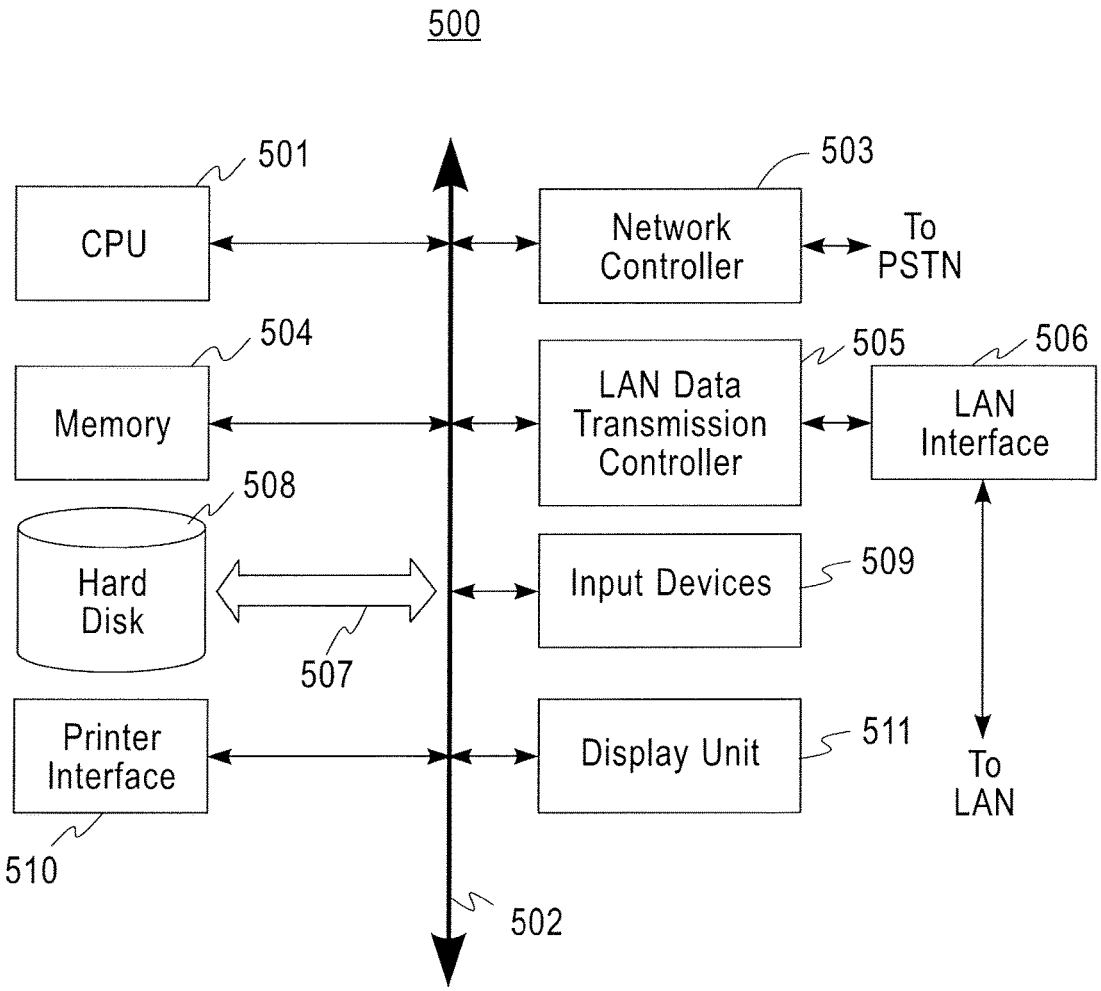
FIG. 5 illustrates an example of a computer system capable of implementing the method according to exemplary embodiments of the present invention.

FIG. 5 illustrates an example of a computer system capable of implementing the methods according to exemplary embodiments of the present invention. The system and method of the present disclosure may be implemented in the form of a software application running on a computer system, for example, a mainframe, personal computer (PC), handheld computer, server, etc. The software application may be stored on a recording media locally accessible by the computer system and accessible via a hard wired or wireless connection to a network, for example, a local area network, or the Internet.

The computer system referred to generally as system 500 may include, for example, a central processing unit (CPU) 501, random access memory (RAM) 504, a printer interface 510, a display unit 511, a local area network (LAN) data transmission controller 505, a LAN interface 506, a network controller 503, an internal bus 502, and one or more input devices 509, for example, a keyboard, mouse etc. As shown, the system 500 may be connected to a data storage device, for example, a hard disk, 508 via a link 507.

Exemplary embodiments of the present invention provide an emergency coordination simulation system including the memory 504 storing a computer program, and a processor 501 configured to execute the computer program. The processor 501 is configured to perform an emergency coordination simulation for a subarea of a geographic region based on expected user behavior in the subarea and environmental variables of the subarea. The processor 501 is configured to transmit an emergency notice to a plurality of users in the subarea based on the emergency coordination simulation. The processor 501 is configured to receive a plurality of citizen sensor reports from the users via citizen sensor monitoring devices. The citizen sensor monitoring devices communicate with the emergency coordination simulation system and form a citizen sensor platform. The processor 501 is configured to perform a consistency check on the plurality of citizen sensor reports by comparing the citizen sensor reports with one another. The processor 501 is configured to filter the plurality of citizen sensor reports to remove outliers based on the consistency check. The processor 501 is configured to perform an emergency coordination resimulation for the subarea based on the expected user behavior in the subarea, the environmental variables of the subarea, and the filtered plurality of citizen sensor reports. The processor 501 is configured to transmit an updated emergency notice to the plurality of users based on the emergency coordination resimulation.

According to an exemplary embodiment of the present invention the processor 501 may be configured to perform additional emergency coordination simulations for neighboring subareas that neighbor the subarea of the geographic region. The processor 501 may be configured to modify the updated emergency notice based on the additional emergency coordination simulations. The processor 501 may be configured to transmit the modified updated emergency notice to the plurality of users.

According to an exemplary embodiment of the present invention the program instructions executable by a processor 501 may cause the processor to perform additional emergency coordination simulations for neighboring subareas that neighbor the subarea of the geographic region. The program instructions executable by a processor 501 may cause the processor to modify the updated emergency notice based on the additional emergency coordination simulations, and transmit the modified updated emergency notice to the plurality of users.

The descriptions of the various exemplary embodiments of the present invention have been presented for purposes of illustration, but are not intended to be exhaustive or limited to the exemplary embodiments disclosed. Many modifications and variations will be apparent to those of ordinary skill in the art without departing from the scope and spirit of the described exemplary embodiments. The terminology used herein was chosen to best explain the principles of the exemplary embodiments, or to enable others of ordinary skill in the art to understand exemplary embodiments described herein.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Exemplary Scenario

According to an exemplary embodiment of the present invention a scenario simulator may be used by the central operation in an emergency coordination environment. This simulator contains a representation of the environment's parameters, including infrastructure, geography, social behavior, traffic conditions, environmental events, and others. These parameters are processed by internal rules to estimate the (possible) evolutions of the environment in the foreseeable future. This information is used by the central operators to reason upon the situation and issue notices to people in the affected areas about the best course of actions, intending to (a) reduce individuals' risk, (b) estimate the evolution of the emergency scenario, (c) predict the amount of resources required by the relief forces, and others.

The notice end-users (e.g., people in affected areas) are equipped with Citizen Sensor Monitors (CSM), which may be applications or software solutions deployed on end-user's mobile computing devices that allow them to report situations on the spot. They receive the notices being issued by the central operations and are able to respond either (i) positively, reinforcing the accuracy of the notice, or (ii) negatively, raising a flag about the accuracy of the notice. Moreover, they can comment on notices being provided to other people nearby in the same fashion, and provide comments on actions being taking by people in surrounding areas, forming a "ad-hoc social network" of notices and reviewing. This information is used to calculate the "reputation coefficient" and assign "priority levels" to the Citizen Sensor Reports. The extended dynamic and self-adjusting scenario simulator according to an exemplary embodiment of the present invention may receive these comments and analyze the comments for accuracy and reliability. If the computation concludes that there is a significant amount of negative comments for notices given in a specific area and/or specific group of people, it will: (a) review the parameters and rules being applied for that specific area and/or specific group of people; (b) re-execute the simulation for that subarea using the new parameters, and; (c) re-issue the notices to that specific areas and/or specific group of people. Thus, the accuracy and reliability of the generated notices may be continually and dynamically increased over time.

While the present invention has been particularly shown and described with reference to exemplary embodiments thereof, it will be understood by those of ordinary skill in the art that various changes in form and detail may be made therein without departing from the spirit and scope of the present invention as defined by the following claims.

The invention claimed is:

1. A method of dynamically adjusting an emergency coordination simulation system, comprising:

performing an emergency coordination simulation for a subarea of a geographic region based on expected user behavior in the subarea and environmental variables of the subarea;

transmitting an emergency notice to a plurality of users in the subarea based on the emergency coordination simulation;

receiving a plurality of citizen sensor reports from the users via citizen sensor monitoring devices, wherein the citizen sensor monitoring devices communicate with a backend system and form a citizen sensor platform, wherein each citizen sensor report comprises first data manually entered by one of the users and second data automatically detected by the citizen sensor monitoring device used by the one of the users;

performing a consistency check on the plurality of citizen sensor reports by comparing the citizen sensor reports with one another, wherein the consistency check comprises comparing citizen reports of the plurality of citizen reports for consistency with real-world observations, and Wherein the comparing citizen reports of the plurality of citizen reports for consistency with real-world observations includes receiving feedback from users of the plurality of users regarding consistency between the emergency notice and real-world observations;

filtering the plurality of citizen sensor reports to remove outliers based on the consistency checks, and to remove citizen sensor reports that are inconsistent with real-world observations, wherein filtering the plurality of citizen sensor reports is further based on area-specific and time-related information;

performing an emergency coordination resimulation for the subarea based on the expected user behavior in the subarea, the environmental variables of the subarea, and the filtered plurality of citizen sensor reports; and transmitting an updated emergency notice to the plurality of users based on the emergency coordination resimulation.

2. The method of claim 1, wherein the second data comprises location data detected by a Global Positioning System (GPS) radio disposed in the citizen sensor monitoring device used by the one of the users.

3. The method of claim 1, wherein the second data comprises a tuple, and the tuple comprises:

a latitude value detected by the corresponding citizen sensor monitoring device and indicating a latitude of the corresponding citizen sensor monitoring device;

a longitude value detected by the corresponding citizen sensor monitoring device and indicating a longitude of the corresponding citizen sensor monitoring device;

an altitude value detected by the corresponding citizen sensor monitoring device and indicating an altitude of the corresponding citizen sensor monitoring device;

a report type value indicating a type of the corresponding citizen sensor report;

a priority value indicating a calculated priority of the corresponding citizen sensor report; and a reputation value indicating a calculated reputation of the corresponding citizen sensor report.

4. The method of claim 1, Wherein the emergency notice and the updated emergency notice each comprise at least one of a description of an emergency in the subarea and a recommended course of action responsive to the emergency in the subarea.

5. The method of claim 1, further comprising:

storing the citizen sensor reports in a database at the backend system; and indexing the citizen sensor reports.

6. The method of claim 1, wherein the citizen sensor monitoring devices are smartphones.

7. The method of claim 1, further comprising:

performing additional emergency coordination simulations for neighboring subareas that neighbor the subarea of the geographic region;

modifying the updated emergency notice based on the additional emergency coordination simulations; and transmitting the modified updated emergency notice to the plurality of users.

8. An emergency coordination simulation system, comprising:

a memory storing a computer program; and a processor configured to execute the computer program, wherein the computer program is configured to:

perform an emergency coordination simulation for a subarea of a geographic region based on expected user behavior in the subarea and environmental variables of the subarea;

transmit an emergency notice to a plurality of users in the subarea based on the emergency coordination simulation;

receive a plurality of citizen sensor reports from the users via citizen sensor monitoring devices, wherein the citizen sensor monitoring devices communicate with the emergency coordination simulation system and form a citizen sensor platform, wherein each citizen sensor report comprises first data manually entered by one of the users and second data automatically detected by the citizen sensor monitoring device used by the one of the users;

perform a consistency check on the plurality of citizen sensor reports by comparing the citizen sensor reports with one another, wherein the consistency check comprises comparing citizen reports of the plurality of citizen reports for consistency with real-world observations, and wherein the comparing citizen reports of the plurality of citizen reports for consistency with real-world observations includes receiving feedback from users of the plurality of users regarding consistency between the emergency notice and real-world observations;

filter the plurality of citizen sensor reports to remove outliers based on the consistency check, and to remove citizen sensor reports that are inconsistent with real-world observations, wherein filtering the plurality of citizen sensor reports is further based on area-specific and time-related information;

perform an emergency coordination resimulation for the subarea based on the expected user behavior in the subarea, the environmental variables of the subarea, and the filtered plurality of citizen sensor reports; and transmit an updated emergency notice to the plurality of users based on the emergency coordination resimulation.

9. The emergency coordination simulation system of claim 8, wherein the second data comprises location data detected by a Global Positioning System (GPS) radio disposed in the citizen sensor monitoring device used by the one of the users.

10. The emergency coordination simulation system of claim 8, wherein the second data comprises a tuple, and the tuple comprises:

a latitude value detected by the corresponding citizen sensor monitoring device and indicating a latitude of the corresponding citizen sensor monitoring device;

a longitude value detected by the corresponding citizen sensor monitoring device and indicating a longitude of the corresponding citizen sensor monitoring device;

an altitude value detected by the corresponding citizen sensor monitoring device and indicating an altitude of the corresponding citizen sensor monitoring device;

a report type value indicating a type of the corresponding citizen sensor report;

a priority value indicating a calculated priority of the corresponding citizen sensor report; and a reputation value indicating a calculated reputation of the corresponding citizen sensor report.

11. The emergency coordination simulation system of claim 8, wherein the emergency notice and the updated emergency notice each comprise at least one of a description of an emergency in the subarea and a recommended course of action responsive to the emergency in the subarea.

12. The emergency coordination simulation system of claim 8, further comprising:

a database, wherein the processor is further configured to store and index the citizen sensor reports in the database.

13. The emergency coordination simulation system of claim 8, wherein the processor is further configured to:

perform additional emergency coordination simulations for neighboring subareas that neighbor the subarea of the geographic region;

modify the updated emergency notice based on the additional emergency coordination simulations; and transmit the modified updated emergency notice to the plurality of users.

14. A computer program product for dynamically adjusting an emergency coordination simulation system, the computer program product comprising a non-transitory computer readable storage medium having program instructions embodied therewith, the program instructions executable by a processor to cause the processor to:

perform an emergency coordination simulation for a subarea of a geographic region based on expected user behavior in the subarea and environmental variables of the subarea;

transmit an emergency notice to a plurality of users in the subarea based on the emergency coordination simulation;

receive a plurality of citizen sensor reports from the users via citizen sensor monitoring devices, wherein the citizen sensor monitoring devices communicate with a backend system and form a citizen sensor platform, wherein each citizen sensor report comprises first data manually entered by one of the users and second data automatically detected by the citizen sensor monitoring device used by the one of the users;

perform a consistency check on the plurality of citizen sensor reports by comparing the citizen sensor reports with one another, wherein the consistency check comprises comparing citizen reports of the plurality of citizen reports for consistency with real-world observations, and wherein the comparing citizen reports of the plurality of citizen reports for consistency with real-world observations includes receiving feedback from users of the plurality of users regarding consistency between the emergency notice and real-world observations;

filter the plurality of citizen sensor reports to remove outliers based on the consistency check, and to remove citizen sensor reports that are inconsistent with real-world observations, wherein filtering the plurality of citizen sensor reports is further based on area-specific and time-related information;

perform an emergency coordination resimulation for the subarea based on the expected user behavior in the subarea, the environmental variables of the subarea, and the filtered plurality of citizen sensor reports; and transmit an updated emergency notice to the plurality of users based on the emergency coordination resimulation.

15. The computer program product of claim 14, wherein the second data comprises a tuple, and the tuple comprises:

a latitude value detected by the corresponding citizen sensor monitoring device and indicating a latitude of the corresponding citizen sensor monitoring device;

a longitude value detected by the corresponding citizen sensor monitoring device and indicating a longitude of the corresponding citizen sensor monitoring device;

an altitude value detected by the corresponding citizen sensor monitoring device and indicating an altitude of the corresponding citizen sensor monitoring device;

a report type value indicating a type of the corresponding citizen sensor report;

a priority value indicating a calculated priority of the corresponding citizen sensor report; and a reputation value indicating a calculated reputation of the corresponding citizen sensor report.

16. The computer program product of claim 14, wherein the emergency notice and the updated emergency notice each comprise at least one of a description of an emergency in the subarea and a recommended course of action responsive to the emergency in the subarea.

17. The computer program product of claim 14, wherein the program instructions executable by the processor further cause the processor to:

perform additional emergency coordination simulations for neighboring subareas that neighbor the subarea of the geographic region;

modify the updated emergency notice based on the additional emergency coordination simulations; and transmit the modified updated emergency notice to the plurality of users.

* * * * *